US006960141B2

(12) United States Patent
Noguchi et al.

(10) Patent No.: US 6,960,141 B2
(45) Date of Patent: Nov. 1, 2005

(54) GOLF CLUB HEAD AND GOLF CLUB

(75) Inventors: Shuichi Noguchi, Osaka (JP); Junichi Dogan, Osaka (JP); Shinichi Inukai, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/744,061

(22) Filed: Dec. 22, 2003

(65) Prior Publication Data

US 2005/0014576 A1 Jan. 20, 2005

(30) Foreign Application Priority Data

Dec. 26, 2002 (JP) ..... 2002-376441

(51) Int. Cl.[7] ..... A63B 53/04
(52) U.S. Cl. ..... 473/328; 473/345; 473/349
(58) Field of Search ..... 473/324–350, 473/290–291; D21/752, 759

(56) References Cited

U.S. PATENT DOCUMENTS 1,868,286 A * 7/1932 Grieve ..... 473/328
5,042,806 A * 8/1991 Helmstetter ..... 473/311
5,301,945 A * 4/1994 Schmidt et al. ..... 473/311
5,366,223 A * 11/1994 Werner et al. ..... 473/349
5,470,068 A * 11/1995 Schmidt et al. ..... 473/311

FOREIGN PATENT DOCUMENTS

JP 11-047318 2/1999
JP 2002-035178 2/2002

* cited by examiner

*Primary Examiner*—Sebastiano Passaniti
(74) *Attorney, Agent, or Firm*—Troutman Sanders LLP; Gerald R. Boss; James Hunt Yancey, Jr.

(57) ABSTRACT

A sole portion of a golf club head includes a first portion contacting with ground in address position and a second portion being raised in a direction from the first portion toward a toe portion. The first and second portions are each in a shape of a curved surface convex toward the outside of a head body. An angle of the second portion with respect to the first portion is adjusted such that an angle formed by a first plane contacting with a vertex of the first portion in address position with a prescribed lie angle and a second plane contacting with a vertex of the second portion becomes at least 30° and at most 60°.

16 Claims, 8 Drawing Sheets

GOLF CLUB HEAD AND GOLF CLUB

This application claims priority based on Japanese Patent Application No. 2002-376441(P), filed Dec. 26, 2002.

BACKGROUND OF THE INVENTION

1. Field of the Invention

The present invention relates to a golf club and a golf club head, and specifically, to a metal golf club head of a large volume (at least 300 ml) and a golf club having such a head.

2. Description of the Background Art

A golf club head with a structure having a metal outer shell can be manufactured with a light and strong material, such as titanium or magnesium, for example. Various golf club heads of large volumes of at least 300 ml have been developed. On the other hand, since a larger golf club head tends to sacrifice control of the head, schemes for improving control of the head have also been developed.

One of the schemes for improving control of the head is a method of shifting the center of gravity of a golf club head toward the axis of a shaft. As one effect of shifting the center of gravity of the head toward the shaft axis, for example, a slice of the ball being hit will be reduced, i.e., the ball will be hit well. Additionally, control of the head in swinging may be facilitated.

Golf club heads in which the center of gravity is shifted toward the shaft axis as described above are disclosed in, for example, Japanese Patent Laying-Open No. 11-47318 and Japanese Patent Laying-Open No. 2002-35178.

In the golf club head disclosed in Japanese Patent Laying-Open No. 11-47318, a weight greater in a specific gravity than a head body is attached to the bottom of a hole for inserting a shaft such that the center of gravity of the head is shifted toward a heel portion side.

In the golf club head disclosed in Japanese Patent Laying-Open No. 2002-35178, a face portion of a head is reduced in thickness from a heel portion side toward a toe portion side such that the center of gravity of the head is shifted toward the heel portion side.

However, the golf club head of Japanese Patent Laying-Open No. 11-47318 requires to attach the weight inside the head, which complicates the manufacturing process of the head. Further, as the weight greater in a specific gravity than the head body is attached, the head increases in mass. This would hinder adjustment of the swing of the golf club, and therefore even when the center of gravity is shifted toward the heel portion side, control of the head can not fully be improved. Thus, there is a limitation in increasing the volume of the head.

As to the golf club head of Japanese Patent Laying-Open No. 2002-35178, the face portion can not be greatly reduced in thickness for durability problems. Thus, the effect related to the reduced weight of the toe portion is limited.

SUMMARY OF THE INVENTION

An object of the present invention is to provide a golf club head capable of setting the center of gravity of a head body to an optimum position without complicating the manufacturing step or increasing the golf club head in mass, and to provide a golf club having such a head.

A golf club head according to the present invention, in one aspect, includes: a sole portion; a crown portion; a toe portion; a heel portion; a face portion; and a back portion. The sole portion includes a first portion contacting with ground in address position and a second portion being raised in a direction from the first portion toward the toe portion. The second portion is in a shape of a curved surface defined by a first curved line passing through a central portion of the second portion and extending in a direction from a boundary portion between the first and second portions toward the toe portion, and a second curved line extending in a direction from the face portion toward the back portion. An angle of the second portion with respect to the first portion is adjusted such that an angle formed by a first plane contacting with the first portion in address position with a prescribed lie angle and a second plane contacting with the second portion at a vertex of the first curved line becomes at least 30° and at most 60°.

A golf club head according to the present invention, in another aspect, includes: a sole portion; a crown portion; a toe portion; a heel portion; a face portion; and a back portion. The sole portion includes a first portion contacting with ground in address position and a second portion being raised in a direction from the first portion toward the toe portion. The second portion is in a shape of a curved surface defined by a curved line extending in a direction from a boundary portion between the first and second portions toward the toe portion, and a straight line extending in a direction from the face portion toward the back portion. An angle of the second portion with respect to the first portion is adjusted such that an angle formed by a first plane contacting with the first portion in address position with a prescribed lie angle and a second plane contacting with the second portion at a vertex of the curved line becomes at least 30° and at most 60°.

A golf club head according to the present invention, in still another aspect, includes: a sole portion; a crown portion; a toe portion; a heel portion; a face portion; and a back portion. The sole portion includes a first portion contacting with ground in address position and a second portion being raised in a direction from the first portion toward the toe portion. The second portion is in a shape of a curved surface defined by a straight line extending in a direction from a boundary portion between the first and second portions toward the toe portion, and a curved line extending in a direction from the face portion toward the back portion. An angle of the second portion with respect to the first portion is adjusted such that an angle formed by a first plane contacting with the first portion in address position with a prescribed lie angle and a second plane contacting with the second portion at a central portion of the second portion becomes at least 30° and at most 60°.

A golf club head according to the present invention, in still another aspect, includes: a sole portion; a crown portion; a toe portion; a heel portion; a face portion; and a back portion. The sole portion includes a first portion contacting with ground in address position and a second portion being raised in a direction from the first portion toward the toe portion. The second portion is in a shape of a plane. An angle of the second portion with respect to the first portion is adjusted such that an angle formed by a first plane contacting with the first portion in address position with a prescribed lie angle and a second plane contacting with the second portion becomes at least 30° and at most 60°.

As described above, by forming the golf club head body such that the toe portion side of the sole portion is raised, the head can be reduced in mass at the toe portion side. Thus, the center of gravity of the head can be shifted toward the heel portion side, i.e., toward the axis of the shaft.

Additionally, by adjusting the angle of the second portion with respect to the first portion contacting with the ground in address position, the center of gravity of the head body can be shifted without sacrificing the balance and the appearance of the head shape.

Further, the golf club head above has a structure with a metal outer shell, in which a thickness of the second portion is at least 0.5 mm and at most 1.0 mm, and the second portion is thinner than the first portion by at least 0.3 mm.

The golf club according to the present invention includes the golf club head described above. As the center of gravity of the head can be set at the optimum position in the golf club, control of the head in swinging can be facilitated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
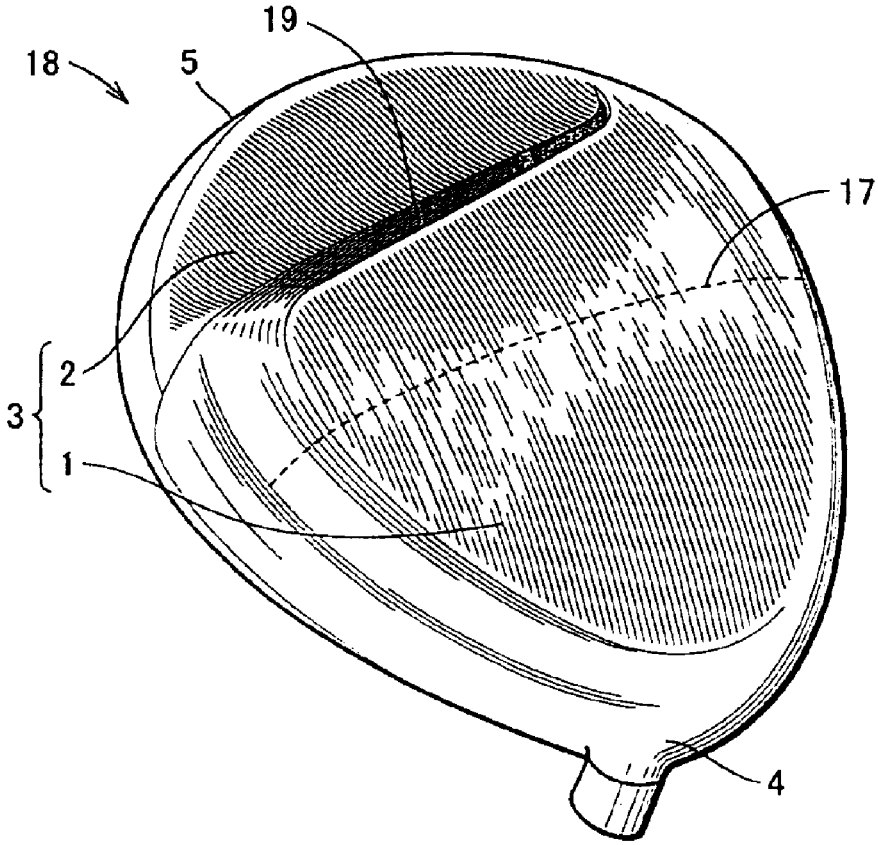
FIG. 1 is a perspective view of a golf club head according to one embodiment of the present invention.

A golf club head according to one embodiment of the present invention includes a sole portion, a crown portion, a toe portion, a heel portion, a face portion, and a back portion.

Generally, the center of gravity of a golf club head is shifted away from the shaft axis as the volume of the golf club head increases. The golf club head according to the present embodiment is assumed to have a structure with a metal outer shell of a large volume of 300 ml–500 ml.

Possible material for the body of the golf club head includes, for example, stainless steel such as SUS 630, titanium alloy (for example, Ti-6Al-4V or Ti-15V-3Cr-3Sn-3Al), pure titanium and the like.

The sole portion described above has a first portion that contacts with the ground in address position. The first portion is the part that contacts with the ground in address position, i.e., when a player gets a golf club ready for hitting, while setting a ball on the flat ground (the underlying base) and putting the head on the ground. The first portion forms the bottom of the head body.

The first portion is formed taking account of stability of the head and its appearance in address position. The first portion is in a shape of a convex curved surface that includes a curved line extending in a direction from the heel portion toward the toe portion and being convex toward the outside of the head body, and a curved line extending in a direction from the face portion toward the back portion and being convex toward the outside of the head body.

A sole center line is a virtual line that crosses the center of the sole portion in a direction from the face portion toward the back portion. For example, an aggregation of vertexes of a curved line extending in a direction from the heel portion toward the toe portion and being convex toward the outside of the head body will be the sole center line. The sole center line includes a curved line extending in the direction from the face portion toward the back portion and that is convex to the outside of the head body, of which vertex is a vertex of a convex curved surface of the first portion.

In addressing the golf club head on the horizontal ground at prescribed lie angle and loft angle, the first portion contacts with a horizontal and virtual first plane at the vertex of the above described convex curved surface.

In the present embodiment, the convex curved lines in the two directions included in the first portion have been described to be the curved lines that are convex toward the outside of the head body. Nevertheless, the convex curved lines in the two directions may each be modified to be a straight line, to be a curved line of convex toward the inside of the head body, or to be a curved line having concave and convex portions. For example, when only the convex curved line extending from the face portion toward the back portion is modified to be a straight line, then the sole center line will be straight, and the first portion contacts with a horizontal first plane on that straight line in address position with prescribed lie angle and loft angle.

The golf club head has a second portion that is raised in a direction from the first portion toward the toe portion side. The second portion is typically raised upward from the first portion with inclination, and does not contact with the ground in normal address position on a flat ground (an underlying base). Accordingly, the appearance of the head can be improved by printing a pattern or by embossing a mark on the second portion. It is noted that preferably the thickness of the second portion is at least 0.5 mm and at most 1.0 mm, (more preferably, about at least 0.7 mm and at most 0.9 mm), which is thinner than the first portion by about at least 0.3 mm (more preferably, about at least 0.4 mm and at most 0.7 mm).

The second portion is raised in a direction from a portion positioned offset from the sole center line of the first position to the toe portion side and where curvature significantly increases (the boundary portion between the first and second portions) toward the toe portion side. The second portion is, for example, in a shape of a convex curved surface that is defined by a first curved line passing the midpoint of a line connecting the face portion end and the back portion end of the second portion or near the midpoint (the central portion of the second portion) and extending in a direction from the boundary portion between the first and second portions toward the toe portion and being convex to the outside of the head body, and a second curved line extending in a direction from the face portion toward the back portion and being convex to the outside of the head body. Here, a plane in contact with the second portion at the vertex of the first curved line is assumed to be a virtual second plane.

Preferably, the boundary portion between the first and second portions is formed in a range of 10 mm to 40 mm offset from the sole center line to the toe portion side. It is noted that the boundary portion is not necessarily parallel with the sole center line.

In the present embodiment, the first and second curved lines in the second portion have been described to be curved lines convex toward the outside of the golf club head in order to ensure the higher rigidity of the sole portion. Nevertheless, the first and second curved lines may each be modified to be a straight line, to be a curved line of convex toward the inside of the head body, or to be a curved line having concave and convex portions. For example, when both of the first and second curved lines are modified to be straight lines, then the central portion of the second portion will be in a shape of a plane. In this case, this plane will be included in the second plane.

In the golf club head according to the present embodiment, the angle of the second portion relative to the first portion is adjusted such that the angle (the acute angle) formed between the first plane and the second plane will be about at least 30° and at most 60° (more preferably, about at least 35° and at most 55°).

By adjusting the angle about at least 30° and forming the sole portion of the golf club head body such that is raised at its toe portion side, the head at its toe portion side can be reduced in mass. Thus, the center of gravity of the head can be shifted toward the heel portion side, i.e., toward the axis of the shaft. Here, setting the angle about at most 60°, the balance and the appearance of the head shape will not be sacrificed.

Additionally, as described above, by making the second portion thinner than the first portion in a certain range, the shifting amount of the center of gravity toward the heel portion side can be increased, while ensuring the reliability and performance of the head.

A golf club according to one embodiment of the present invention includes a golf club head having the features described above, a shaft and a grip. Known elements can be employed as the shaft and the grip. The golf club enables to set the center of the gravity of the head to the optimum position, and therefore control of the head in swinging is facilitated.

In the following, referring to FIGS. 1 to 12, further specific embodiments of the golf club head and the golf club will be described.

Figure 2:
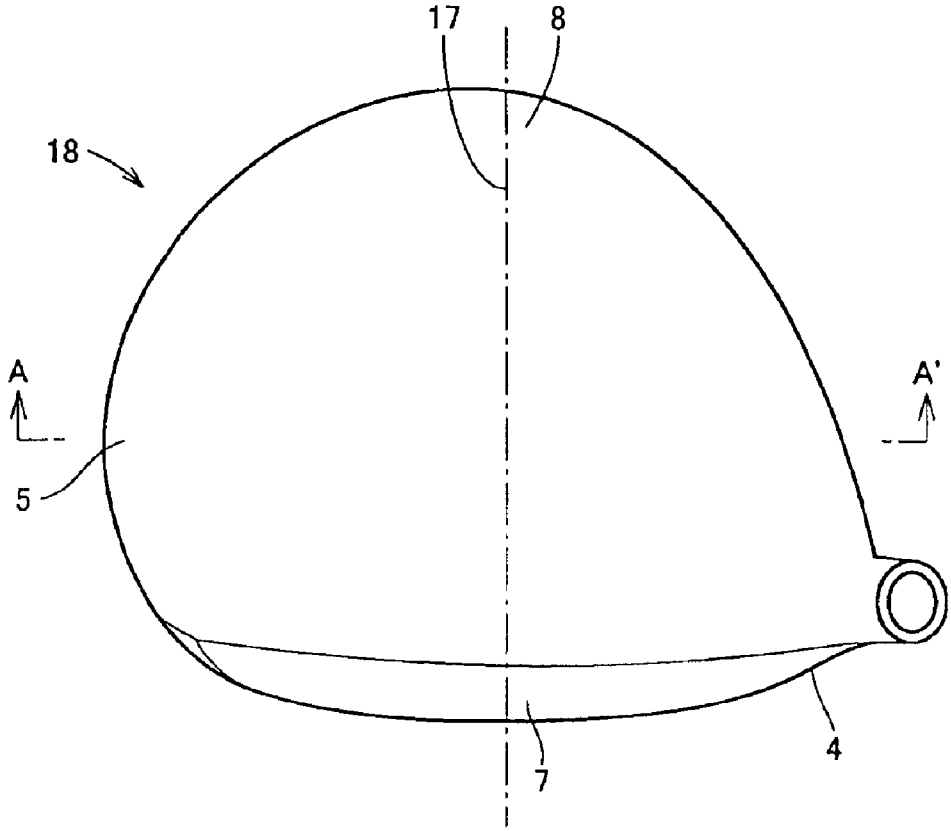
FIG. 2 is a plan view of a golf club head according to one embodiment of the present invention.

FIG. 1 is a perspective view of a golf club head 18 of the present embodiment, while FIG. 2 is a plan view of golf club head 18. The head body of golf club head 18 has a hollow outer shell structure formed by casting, using titanium alloy such as Ti-6Al-4V, for example. The golf club of the present embodiment includes golf club head 18, a shaft and a grip that are not shown.

As shown in FIGS. 1 and 2, golf club head 18 includes a sole portion 3, a crown portion 6 (see FIG. 8), a heel portion 4, a toe portion 5, a face portion 7, and a back portion 8.

Sole portion 3 includes a first portion 1 contacting with the ground (the underlying base) on a sole center line 17 in address position and forms the bottom of the head body, and a second portion 2 being raised upward with inclination (toward the toe portion side) from a boundary portion 19 between first portion 1 and second portion 2 and that does not contact with the ground (the underlying base) in address position.

Figure 3:
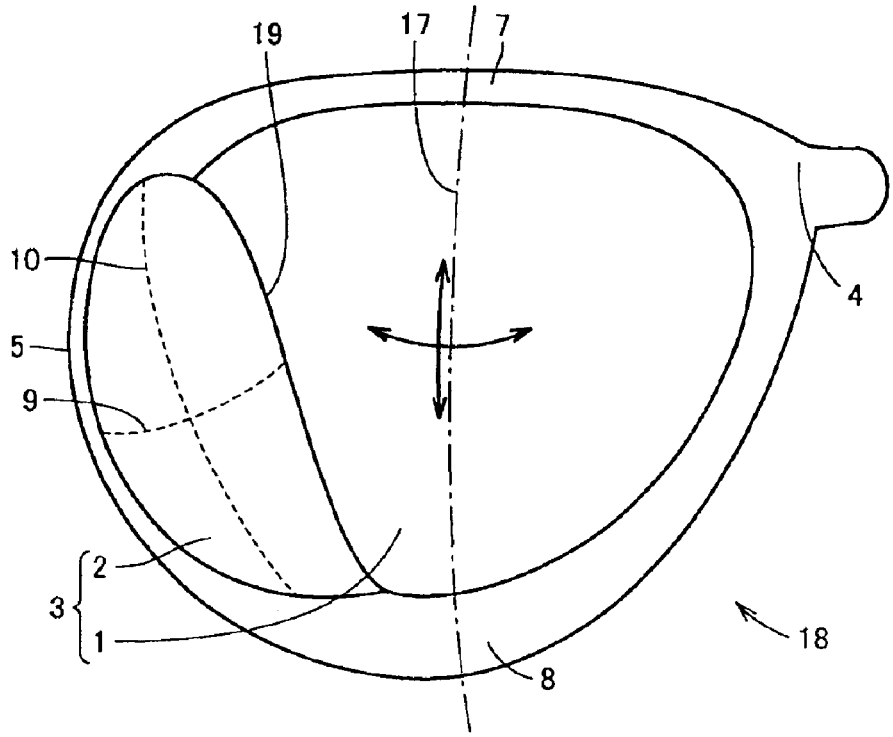
FIG. 3 is a bottom view of a golf club head according to one embodiment of the present invention.

The shape of sole portion 3 will be described in detail below. FIG. 3 is a bottom view of golf club head 18.

As shown in FIG. 3, first portion 1 has a shape including a moderately curved surface that is convex toward the outside of the head. Sole center line 17 extends the central portion of first portion 1. Boundary portion 19 between first portion 1 and second portion 2 is provided at the position offset from sole center line 17 toward toe portion 5 side, by about 20 mm to 40 mm at face portion 7 side, and by about 10 mm to 20 mm at back portion 8 side.

Second portion 2 is raised toward toe portion 5 side from boundary portion 19 that is offset from sole center line 17 toward toe portion 5. Second portion 2 is in a shape of a curved surface including a first curved line 9 passing through the central portion of the second portion 2 and extending in a direction from boundary portion 19 between first portion 1 and second portion 2 toward toe portion 5 side and being convex to the outside of the head body, and a second curved line 10 extending in a direction from face portion 7 toward back portion 8 and being convex to the outside of the head body.

Figure 4:
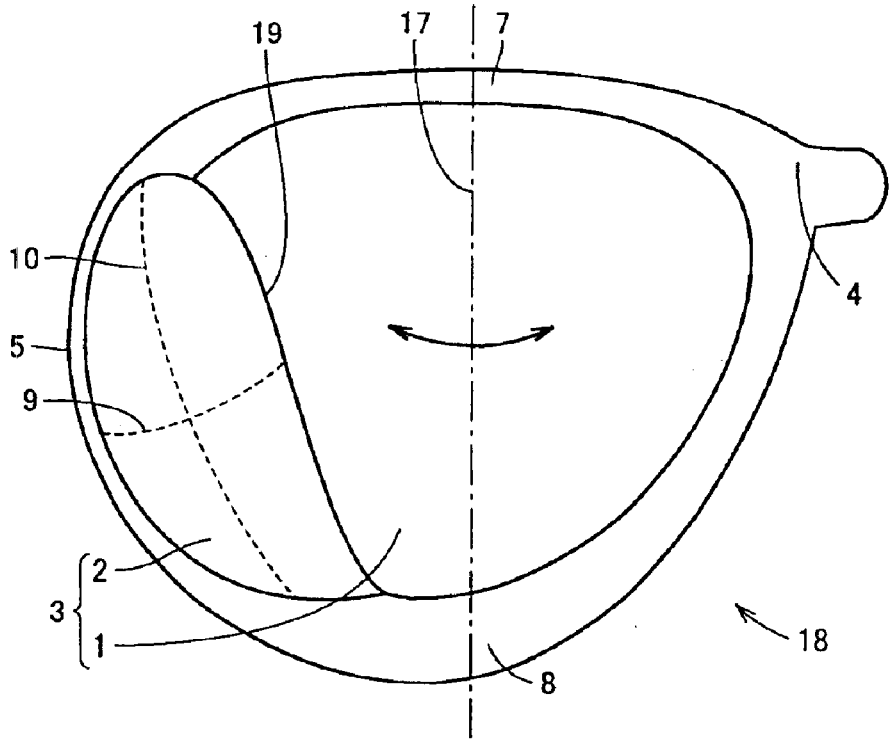
FIG. 4 is a bottom view of a variation of a golf club head according to one embodiment of the present invention.

FIG. 4 shows a variation of first portion 1. As shown in FIG. 4, first portion 1 can be formed as a straight shape in a direction from the face portion 7 to the back portion 8. In this case, the sole center line 17 will be straight.

Figure 5:
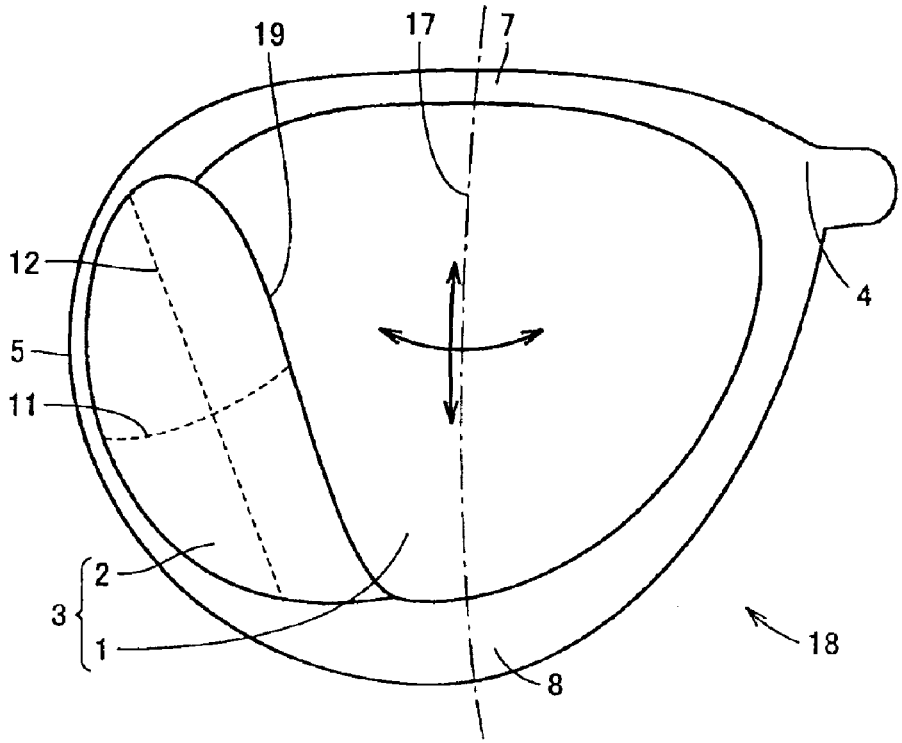
FIG. 5 is a bottom view of another variation of a golf club head according to one embodiment of the present invention.
Figure 6:
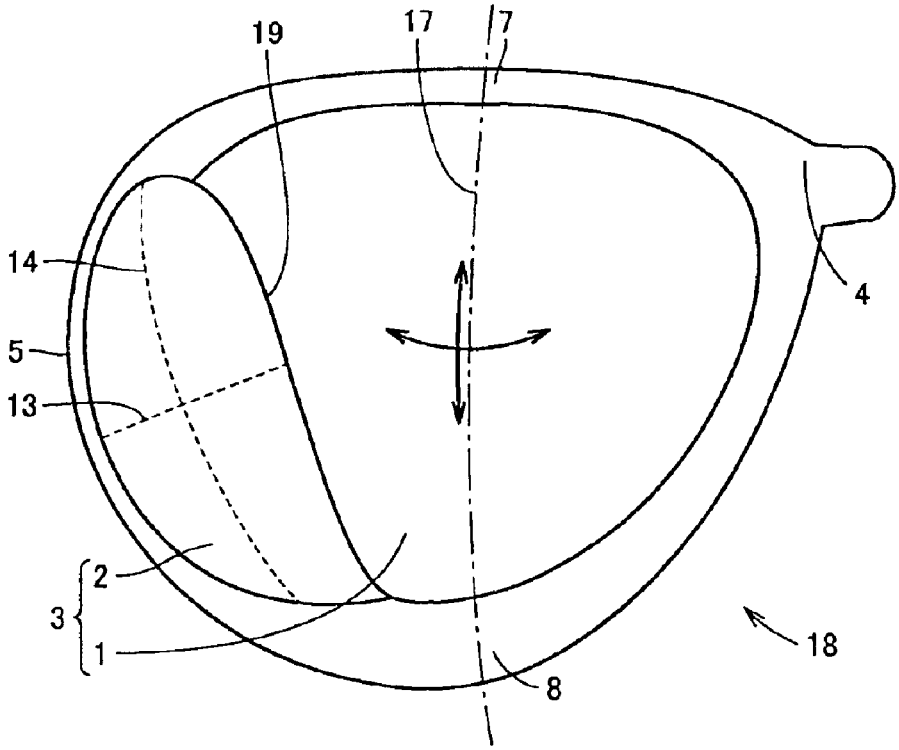
FIG. 6 is a bottom view of still another variation of a golf club head according to one embodiment of the present invention.
Figure 7:
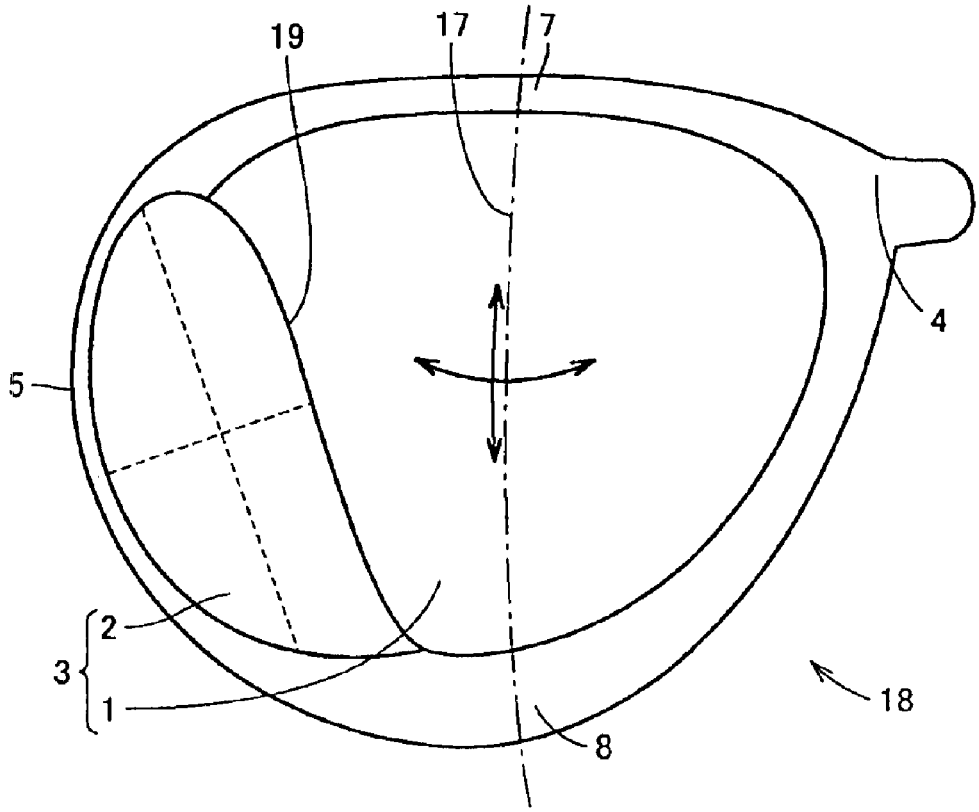
FIG. 7 is a bottom view of still another variation of a golf club head according to one embodiment of the present invention.

Possible variations of second portion 2 may include, for example, a case where a convex curved line 11 (passing through the central portion of the second portion 2 and extending in a direction from boundary portion 19 to toe portion 5) and a straight line 12 (extending in a direction from face portion 7 to back portion 8) are included as shown in FIG. 5, a case where straight line 13 (passing through the central portion of the second portion 2 and extending in a direction from boundary portion 19 to toe portion 5) and a convex curved line 14 (extending in a direction from face portion 7 to back portion 8) are included as shown in FIG. 6, or a case where a shape of a plane shown in FIG. 7 is included.

As to curved lines 9, 10, 11 and 14, they each may be a curved line convex to the inside of the head body or a curved line having concave and convex portions, in addition to the variations above.

Figure 8:
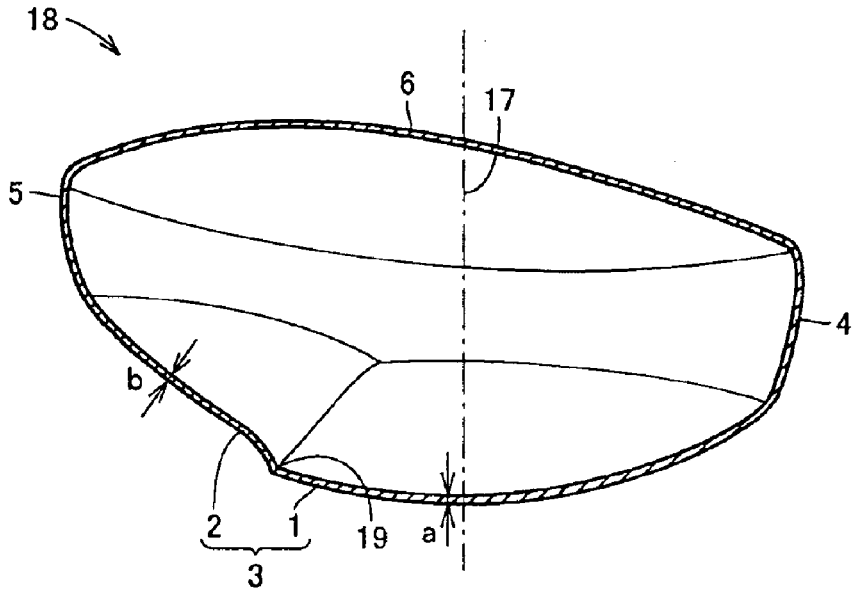
FIG. 8 is a cross-sectional view of a golf club head according to one embodiment of the present invention.
Figure 9:
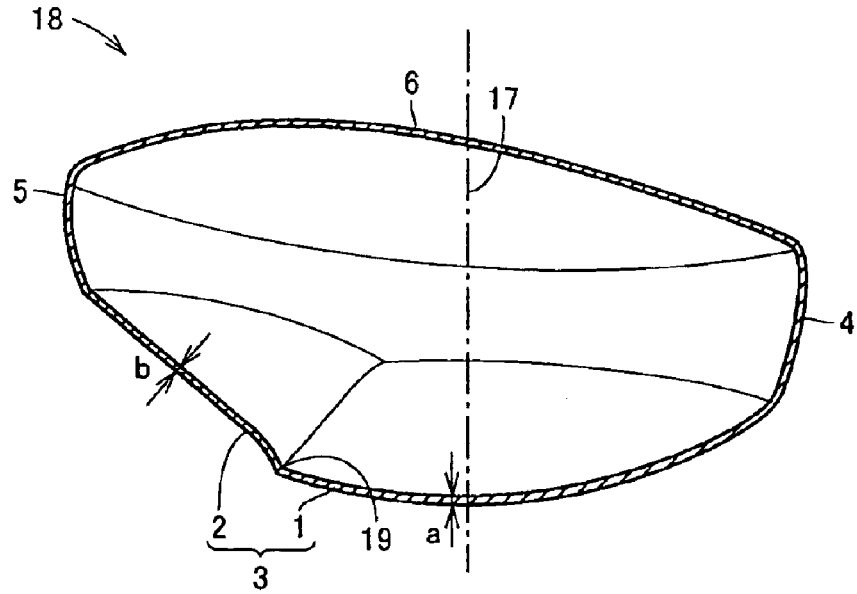
FIG. 9 is a cross-sectional view of a variation of a golf club head according to one embodiment of the present invention.
Figure 10:
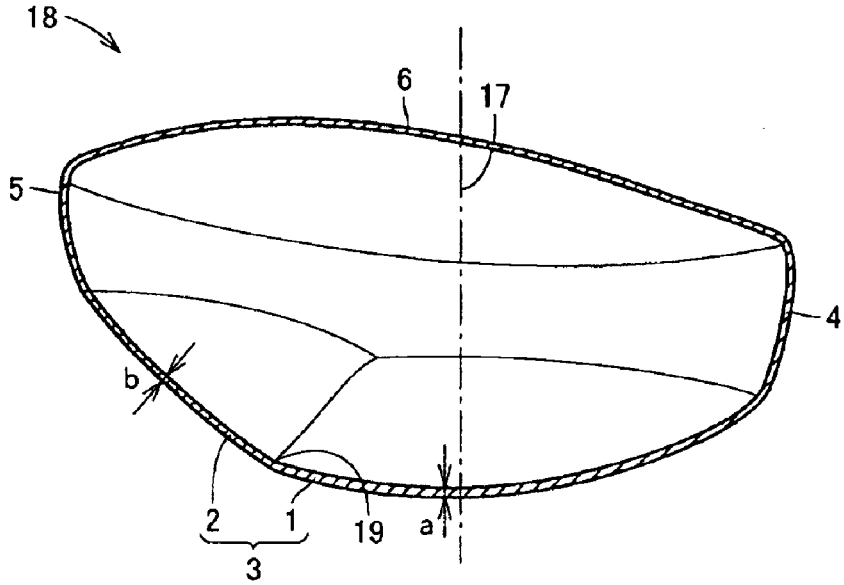
FIG. 10 is a cross-sectional view of another variation of a golf club head according to one embodiment of the present invention.
Figure 11:
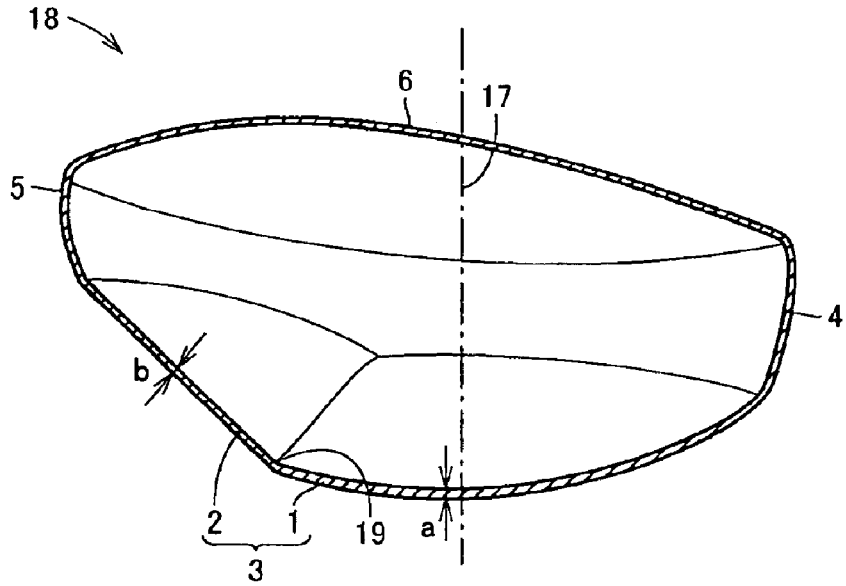
FIG. 11 is a cross-sectional view of still another variation of a golf club head according to one embodiment of the present invention.

FIG. 8 is a cross-sectional view (along A–A' in FIG. 2) where second portion 2 includes a convex curved line in a direction from boundary portion 19 toward toe portion 5 (FIGS. 3, 4 and 5). Similarly, FIG. 9 is a cross-sectional view where second portion 2 includes a straight line in a direction from boundary portion 19 toward toe portion 5 (FIGS. 6 and 7). As shown in FIGS. 8 and 9, second portion 2 is in a shape including a moderately curved surface that is convex to the outside of the head or a shape of a plane, and a curved surface convex to the inside with a large curvature near boundary portion 19. This curved surface convex to the inside can be omitted, as shown in FIG. 10 (a variation of FIG. 8) and FIG. 11 (a variation of FIG. 9).

Figure 12:
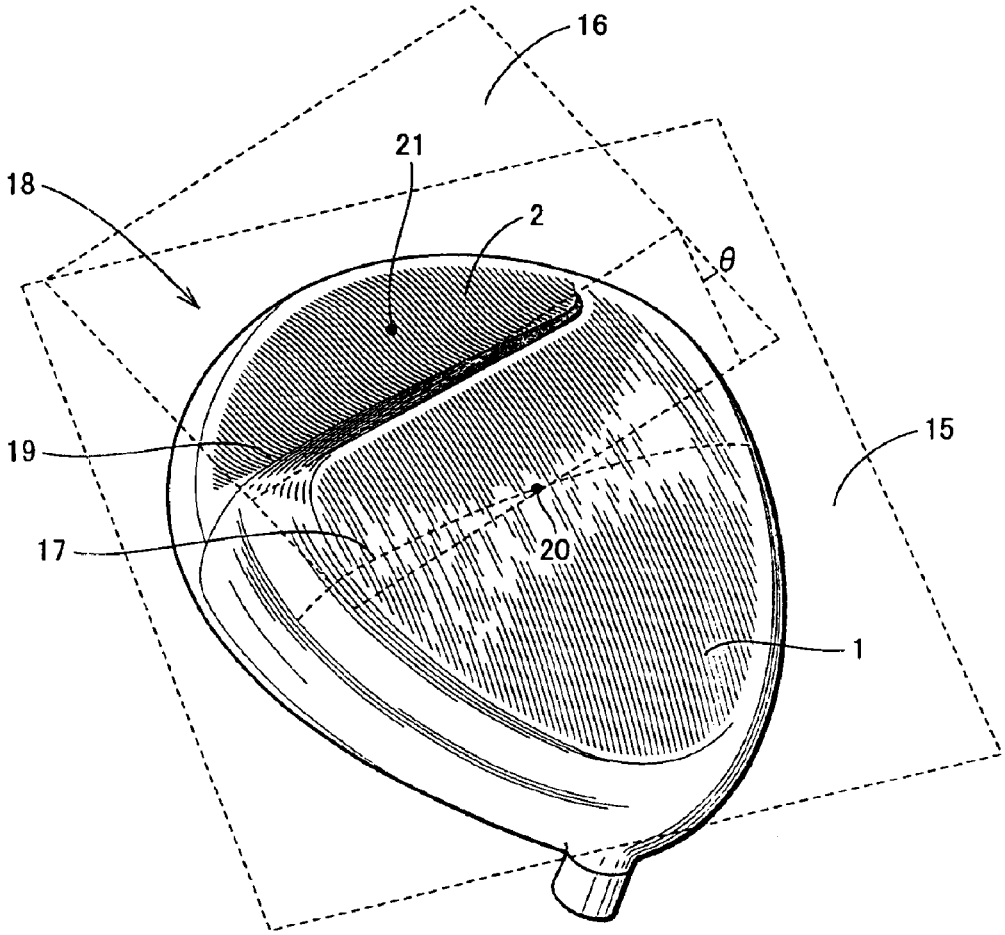
FIG. 12 is a perspective view showing a virtual plane contacting with a golf club head according to one embodiment of the present invention.

In addressing the golf club head on the horizontal ground at prescribed lie angle and loft angle, the first portion 1 contacts with a horizontal and virtual first plane 15 at a vertex 20 of a convex curved surface positioned on the sole center line 17 as shown in FIG. 12. It is noted that, when first portion 1 is in a straight shape in a direction from the face portion toward the back portion, first portion 1 contacts with first plane 15 on sole center line 17.

A plane in contact with second portion 2 at a vertex 21 of first curved plane 9 is assumed to be a virtual second plane 16.

A plane in contact with second portion 2 on a straight or curved line including the vertex of curved line 11 in the variation of FIG. 5, as well as on the central portion of second portion 2 in the variation of FIG. 6, is assumed to be a virtual second plane 16. In FIG. 7, a plane including the central portion of second portion 2 is assumed to be second plane 16.

The angle formed by first plane 15 and second plane 16 (θ in FIG. 12) is assumed to be 40°. First portion 1 of sole portion 3 has a thickness of about 0.7 mm to 0.9 mm, while second portion 2 has a thickness of about 1.3 mm to 1.6 mm. The volume of golf club head 18 is 400 ml.

Golf club head 18 according to the present embodiment having the structure above is lighter at the toe portion than a head body of the same volume having a conventional structure, which does not include second portion 2 at sole portion 3, by about 6 g. Accordingly, when manufacturing a head body of the same weight as the conventionally structured head body, a weight of about 6 g can be added to the heel portion side. This enables to shift the center of gravity of golf club head 18 toward the axis of the shaft by about 1.5 mm.

Table 1 shows the result of a hitting test performed using the golf club according to the present embodiment and a conventional golf club, which does not have second portion 2 at sole portion 3 of the head body. It is noted that the weight (195 g), and the volume (400 ml) of the head body and members other than the head body (for example, a grip, a shaft and the like) are the same for both of the golf clubs.

TABLE 1

| Golf Club | Hook Direction (Yard) | Slice Direction (Yard) |
|---|---|---|
| Conventional | −5 | +20 |
| Present Embodiment | −10 | +4 |

In the hitting test, ten experienced players each hit 100 balls. For each ball being hit, the distance of deviation from an intended direction was measured to determine the average. In Table 1, the intended direction is assumed to be 0, and the hook direction therefrom is indicated with − and the slice direction therefrom is indicated with +.

According to the test result shown in Table 1, the balls hit by the golf club with golf club head 18 of the present embodiment are likely to hook (less likely to slice), and, as a whole, the directions of the balls are less varied. This shows that the golf club according to the present embodiment hits the ball better than the conventional club and provides easier control.

As described above, according to the present invention, a golf club head and a golf club can be provided, in which the center of gravity of the head is set to the optimum position without complexing the manufacturing steps or increasing the mass of the golf club head.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A wood-type golf club head, comprising:

a sole portion having a sole center line;

a crown portion;

a toe portion;

a heel portion;

a face portion;

and a back portion, wherein said sole portion includes a first portion contacting with ground in address position and a second portion being raised in a direction from the first portion toward said toe portion, said second portion is in a shape of a curved surface defined by a first curved line passing through a central portion of the second portion and extending in a direction from a boundary portion between said first and second portions toward said toe portion, and a second curved line extending in a direction from said face portion toward said back portion, an angle of said second portion with respect to said first portion is adjusted such that an angle formed by a first plane contacting with said first portion in address position with a prescribed lie angle and a second plane contacting with said second portion at a vertex of said first curved line becomes at least 30 degrees and at most 60 degrees; and wherein a gradient of said sole portion varies gently on a heel portion side relative to said sole center line, said boundary portion between said first and second portions is positioned on a toe portion side relative to said sole center line, and a gradient of said sole portion varies steeply in said boundary portion.

2. The wood-type golf club head according to claim 1, wherein said wood-type golf club head has a structure having a metal outer shell, a thickness of said second portion is at least 0.5 mm and at most 1.0 mm, and said second portion is thinner than said first portion by at least 0.3 mm such that the mass of the toe portion is less than the mass of the heel portion.

3. A golf club comprising the wood-type golf club head according to claim 1.

4. The wood-type golf club head of claim 1, wherein the boundary portion has a width that varies from the face portion to the back portion and is offset from the sole center line in a range of approximately 10 mm to approximately 40 mm.

5. A wood-type golf club head, comprising:

a sole portion having a sole center line;

a crown portion;

a toe portion;

a heel portion;

a face portion;

and a back portion, wherein said sole portion includes a first portion contacting with ground in address position and a second portion being raised in a direction from the first portion toward said toe portion, said second portion is in a shape of a curved surface defined by a curved line extending in a direction from a boundary portion between said first and second portions toward said toe portion, and a straight line extending in a direction from said face portion toward said back portion, an angle of said second portion with respect to said first portion is adjusted such that an angle formed by a first plane contacting with said first portion in address position with a prescribed lie angle and a second plane contacting with said second portion at a vertex of said curved line becomes at least 30 degrees and at most 60 degrees; and wherein a gradient of said sole portion varies gently on a heel portion side relative to said sole center line, said boundary portion between said first and second portions is positioned on a toe portion side relative to said sole center line, and a gradient of said sole portion varies steeply in said boundary portion.

6. The wood-type golf club head according to claim 5, wherein said wood-type golf club head has a structure having a metal outer shell, a thickness of said second portion is at least 0.5 mm and at most 1.0 mm, and said second portion is thinner than said first portion by at least 0.3 mm such that the mass of the toe portion is less than the mass of the heel portion.

7. A golf club comprising the wood-type golf club head according to claim 5.

8. The wood-type golf club head of claim 5, wherein the boundary portion has a width that varies from the face portion to the back portion and is offset from the sole center line in a range of approximately 10 mm to approximately 40 mm.

9. A wood-type golf club head, comprising:

a sole portion having a sole center line;

a crown portion;

a toe portion;

a heel portion;

a face portion;

and a back portion, wherein said sole portion includes a first portion contacting with ground in address position and a second portion being raised in a direction from the first portion toward said toe portion, said second portion is in a shape of a curved surface defined by a straight line extending in a direction from a boundary portion between said first and second portions toward said toe portion, and a curved line extending in a direction from said face portion toward said back portion, an angle of said second portion with respect to said first portion is adjusted such that an angle formed by a first plane contacting with said first portion in address position with a prescribed lie angle and a second plane contacting with said second portion at a central portion of said second portion becomes at least 30 degrees and at most 60 degrees; and wherein a gradient of said sole portion varies gently on a heel portion side relative to said sole center line, said boundary portion between said first and second portions is positioned on a toe portion side relative to said sole center line, and a gradient of said sole portion varies steeply in said boundary portion.

10. The wood-type golf club head according to claim 9, wherein said wood-type golf club head has a structure having a metal outer shell, a thickness of said second portion is at least 0.5 mm and at most 1.0 mm, and said second portion is thinner than said first portion by at least 0.3 mm such that the mass of the toe portion is less than the mass of the heel portion.

11. A golf club comprising the wood-type golf club head according to claim 9.

12. The wood-type golf club head of claim 9, wherein the boundary portion has a width that varies from the face portion to the back portion and is offset from the sole center line in a range of approximately 13 mm to approximately 40 mm.

13. A wood-type golf club head, comprising:

a sole portion having a sole center line;

a crown portion;

a toe portion;

a heel portion;

a face portion;

and a back portion, wherein said sole portion includes a first portion contacting with ground in address position and a second portion being raised in a direction from the first portion toward said toe portion, said second portion is in a shape of a plane, an angle of said second portion with respect to said first portion is adjusted such that an angle formed by a first plane contacting with said first portion in address position with a prescribed lie angle and a second plane contacting with said second portion becomes at least 30 degrees and at most 60 degrees; and wherein a gradient of said sole portion varies gently on a heel portion side relative to said sole center line, said boundary portion between said first and second portions is positioned on a toe portion side relative to said sole center line, and a gradient of said sole portion varies steeply in said boundary portion.

14. The wood-type golf club head according to claim 13, wherein said wood-type golf club head has a structure having a metal outer shell, a thickness of said second portion is at least 0.5 mm and at most 1.0 mm, and said second portion is thinner than said first portion by at least 0.3 mm such that the mass of the toe portion is less than the mass of the heel portion.

15. A golf club comprising the wood-type golf club head according to claim 13.

16. The wood-type golf club head of claim 13, wherein the boundary portion has a width that varies from the face portion to the back portion and is offset from the sole center line in a range of approximately 10 mm to approximately 40 mm.

* * * * *